US011241343B2

(12) United States Patent
Xu et al.

(10) Patent No.: US 11,241,343 B2
(45) Date of Patent: Feb. 8, 2022

(54) PATIENT SUPPORT APPARATUS FOR SUPPORTING A PATIENT FOR MOVEMENT ASSISTED BY FIRST AND SECOND CAREGIVERS

(71) Applicant: Stryker Corporation, Kalamazoo, MI (US)

(72) Inventors: Shaofei Wilson Xu, Kalamazoo, MI (US); Lance E. Larsen, Grand Rapids, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 17/077,027

(22) Filed: Oct. 22, 2020

(65) Prior Publication Data

US 2021/0113393 A1 Apr. 22, 2021

Related U.S. Application Data

(60) Provisional application No. 62/924,308, filed on Oct. 22, 2019.

(51) Int. Cl.

| | |
|---|---|
| ***A61G 1/06*** | (2006.01) |
| ***A61G 1/003*** | (2006.01) |
| ***A61G 1/048*** | (2006.01) |
| ***A61G 1/013*** | (2006.01) |

(52) U.S. Cl.

CPC ..... *A61G 1/003* (2013.01); *A61G 1/013* (2013.01); *A61G 1/048* (2013.01); *A61G 1/06* (2013.01)

(58) Field of Classification Search

CPC ..... A61G 1/00; A61G 1/003; A61G 1/013; A61G 1/04; A61G 1/048; A61G 1/06

See application file for complete search history.

(56) References Cited

U.S. PATENT DOCUMENTS

| | | | | |
|---|---|---|---|---|
| 4,393,529 | A * | 7/1983 | Britz | A61G 5/00 297/130 |
| 7,398,571 | B2 | 7/2008 | Souke et al. | |
| 9,486,373 | B2 | 11/2016 | Lambarth et al. | |
| 9,510,981 | B2 | 12/2016 | Lambarth et al. | |

(Continued)

OTHER PUBLICATIONS

U.S. Appl. No. 17/077,003, filed Oct. 22, 2020.

*Primary Examiner* — Fredrick C Conley

(74) *Attorney, Agent, or Firm* — Howard & Howard Attorneys PLLC

(57) ABSTRACT

A patient support apparatus supports a patient for movement assisted by first and second caregivers and includes a litter. The litter includes a patient support deck extending between first and second ends and defines at least one cavity. First and second evacuation interfaces are coupled to the litter. The first and second evacuation interfaces pivot between first and second unfolded positions and first and second upright positions, respectively, and move between first and second lengthened positions and first and second shortened positions, respectively. The first and second evacuation interfaces are disposed in the cavity when the first and second evacuation interfaces are in the first and second unfolded positions and the first and second shortened positions, respectively, and configured to be grasped and lifted by the first and second caregivers when the first and second evacuation interfaces are in the first and second upright positions, respectively.

16 Claims, 12 Drawing Sheets

(56) References Cited

U.S. PATENT DOCUMENTS

| | | | | |
|---|---|---|---|---|
| 2010/0257673 | A1* | 10/2010 | Linares | A61G 1/0237 5/626 |
| 2018/0028383 | A1* | 2/2018 | Stryker | A61G 1/017 |
| 2018/0177652 | A1 | 6/2018 | Furman et al. | |
| 2018/0185212 | A1 | 7/2018 | Lucas et al. | |
| 2018/0185213 | A1 | 7/2018 | Naber et al. | |
| 2018/0369036 | A1 | 12/2018 | Furman et al. | |
| 2020/0155380 | A1* | 5/2020 | Xu | A61G 1/003 |

* cited by examiner

PATIENT SUPPORT APPARATUS FOR SUPPORTING A PATIENT FOR MOVEMENT ASSISTED BY FIRST AND SECOND CAREGIVERS

RELATED APPLICATIONS

This application claims priority to and the benefit of U.S. Provisional Patent Application No. 62/924,308, filed on Oct. 22, 2019, the entire contents of which are hereby incorporated by reference.

BACKGROUND

Patient support apparatuses facilitate care of patients in a health care setting and are typically, for example, hospital beds, stretchers, cots, tables, wheelchairs, and chairs. A conventional patient support apparatus comprises a base and a litter upon which the patient is supported.

In certain circumstances (such as first response scenarios) caregivers must travel to the patient and transport the patient back to an emergency medical facility. The caregivers must transport the patient support apparatus to the patient to provide care. Often, the patient support apparatus has handles, side boards, and medical equipment structures that protrude from the litter, which makes the patient support apparatus cumbersome to transport to the patient.

DETAILED DESCRIPTION OF THE EMBODIMENTS

Figure 1:
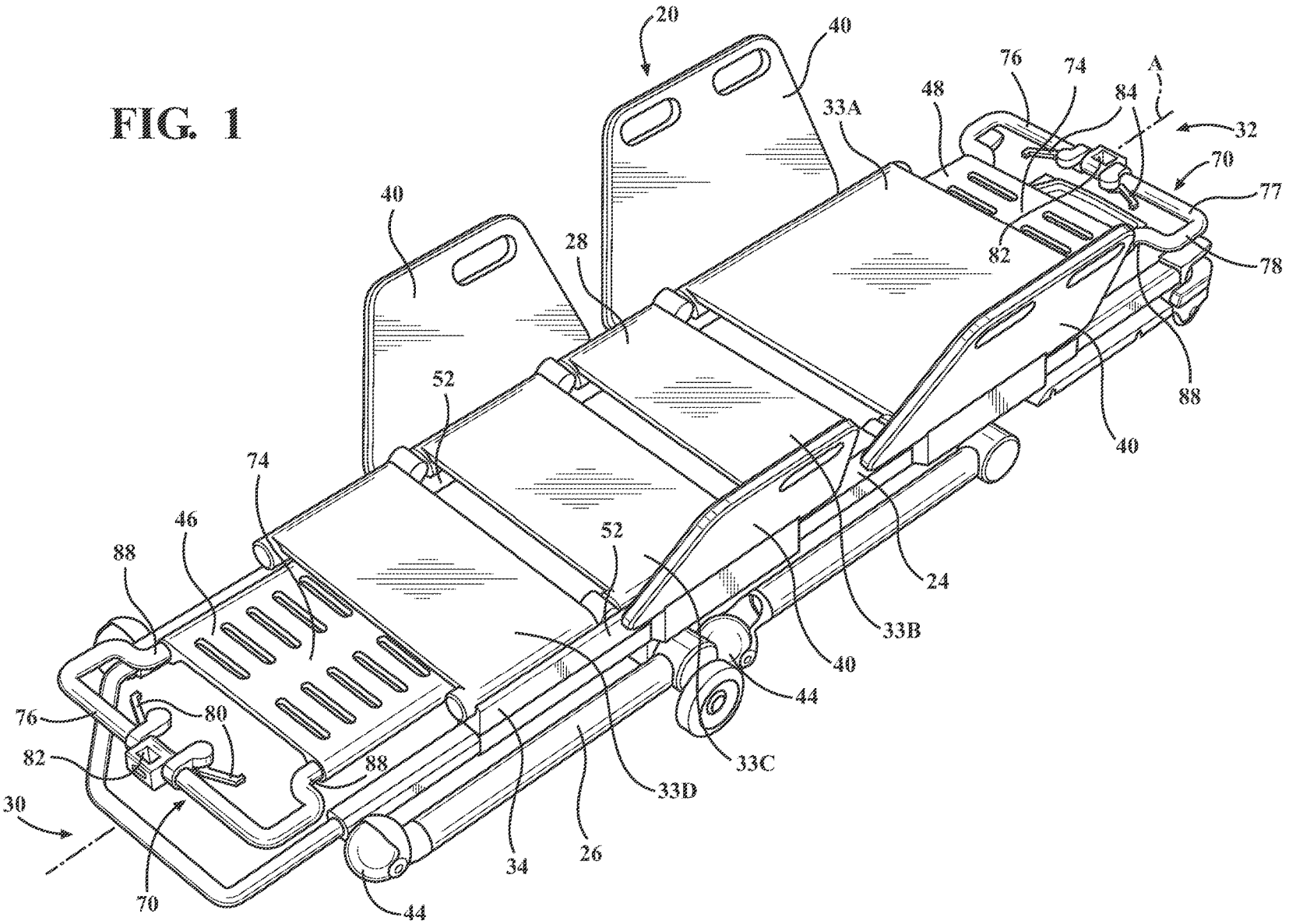
FIG. 1 is a perspective view of a patient support apparatus shown comprising a litter, first and second evacuation interfaces, and a base.

Referring to FIGS. 1, 4, and 9-11, a patient support apparatus is shown at 20 for supporting a patient 22 for movement assisted by first and second caregivers 25, 27 in a health care setting. As will be appreciated from the subsequent description below, while the illustrated embodiments of the patient support apparatus 20 described herein are configured as a stretcher for transporting patients 22, the patient support apparatus 20 may comprise a hospital bed, a table, a cot, a wheelchair, a chair, or a similar apparatus utilized in the care of the patient 22. The embodiment of the patient support apparatus 20 shown in the Figures generally comprises a litter 24, which is described in greater detail below.

In some embodiments, the patient support apparatus 20 may comprise a reconfigurable patient support as described in U.S. Pat. No. 9,486,373, which is hereby incorporated by reference in its entirety. In some embodiments, the patient support apparatus 20 may comprise a reconfigurable transport apparatus as described in U.S. Pat. No. 9,510,981, which is hereby incorporated by reference in its entirety. In some embodiments, the patient support apparatus 20 may comprise a person support apparatus system as described in U.S. Patent Application Publication No. 2018/0028383, which is hereby incorporated by reference in its entirety. In some embodiments, the patient support apparatus 20 may comprise a patient transfer apparatus with integrated tracks as described in U.S. Patent Application Publication No. 2018/0185212, which is hereby incorporated by reference in its entirety. In some embodiments, the patient support apparatus 20 may comprise a variable speed patient transfer apparatus as described in U.S. Patent Application Publication No. 2018/0177652, which is hereby incorporated by reference in its entirety. In some embodiments, the patient support apparatus 20 may comprise a patient transfer apparatus as described in U.S. Patent Application Publication No. 2018/0185213, which is hereby incorporated by reference in its entirety. In some embodiments, the patient support apparatus 20 may comprise an ambulance cot as described in U.S. Pat. No. 7,398,571, which is hereby incorporated by reference in its entirety.

Figure 4:
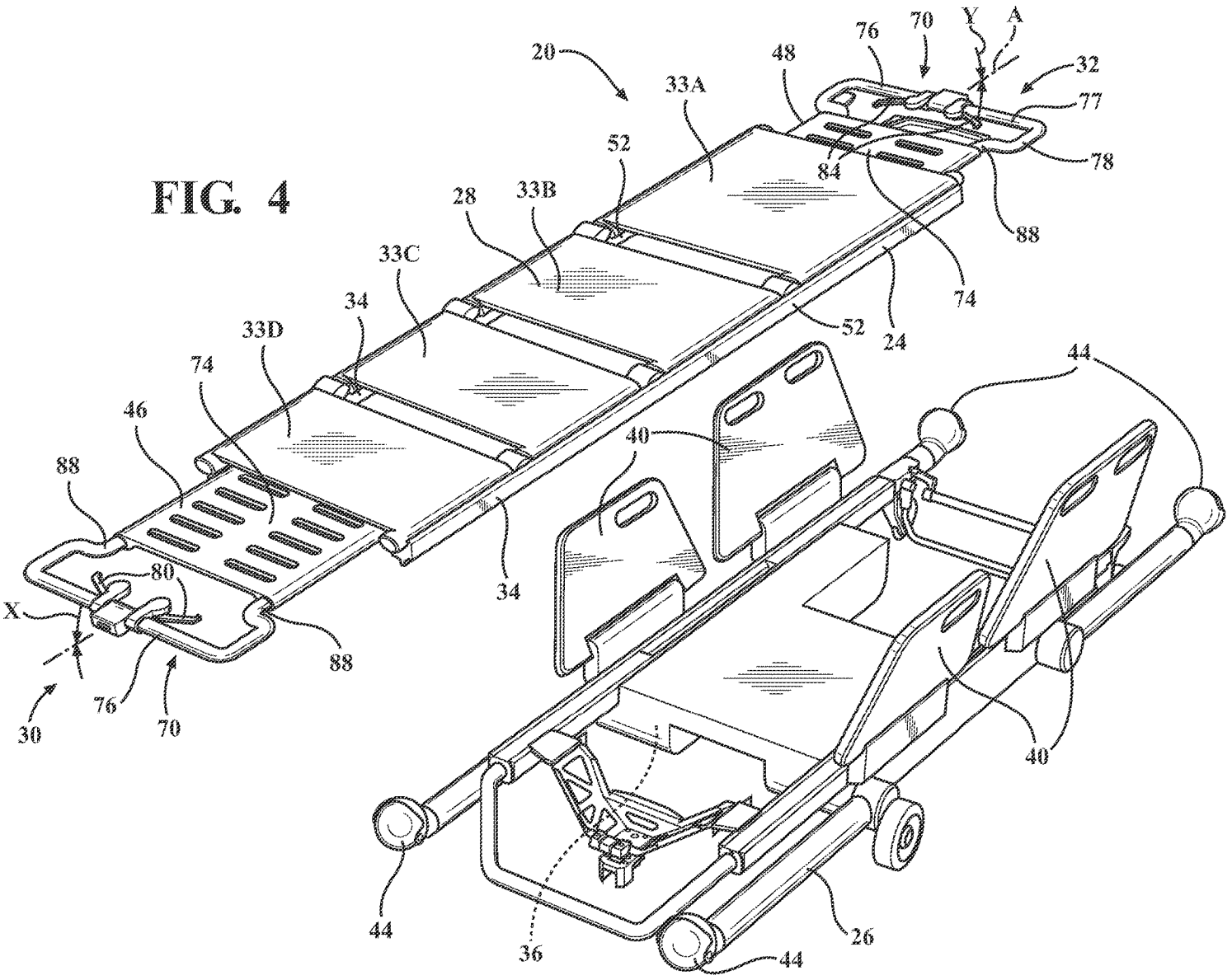
FIG. 4 is a perspective view of the patient support apparatus, with the base separated from the litter.
Figure 8:
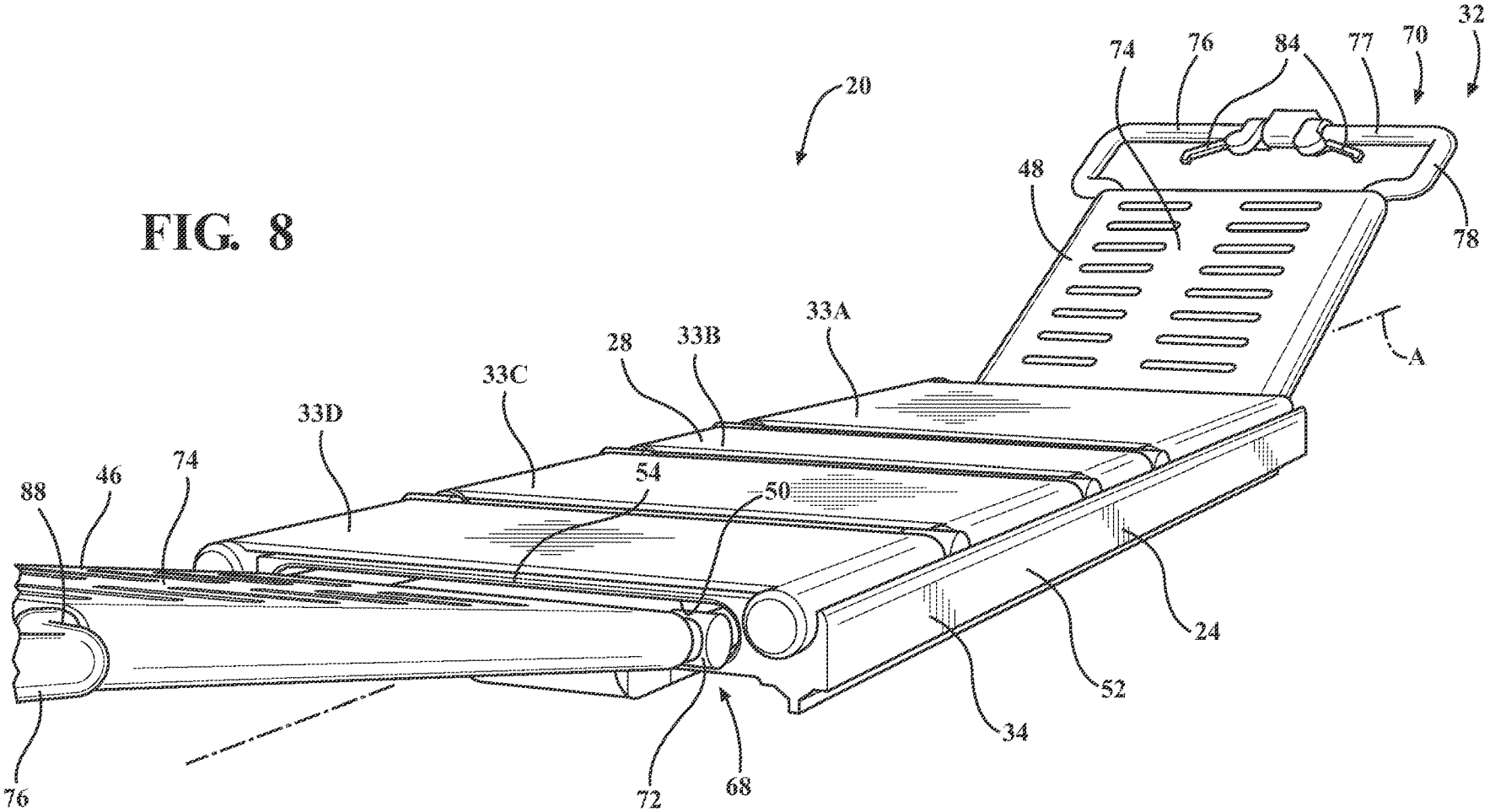
FIG. 8 is a perspective view of the patient support apparatus with the base removed.

In the illustrated embodiment, the patient support apparatus 20 comprises the litter 24. The litter 24 comprises a patient support deck 28 configured to support the patient 22. As shown in the Figures, the litter 24 extends longitudinally along an axis A between a first end 30 and a second end 32. The patient support deck 28 of the litter 24 may comprise a plurality of sections 33, as shown in FIGS. 1, 4, and 8. In the embodiment shown in the Figures, the plurality of sections 33 are further defined as four sections 33A-D, positioned end-to-end in succession along the axis A between the first and second ends 30, 32 of the litter 24. Some or all of the sections 33A-D may be capable of being articulated relative to adjacent sections 33A-D. The articulation of the sections 33A-D may configure the litter 24 to transport patients 22 in a seated position (as shown in FIG. 10), which facilitates evacuation of patients 22 from buildings where patient accessibility is limited, such as buildings having more than one floor.

Figure 9:
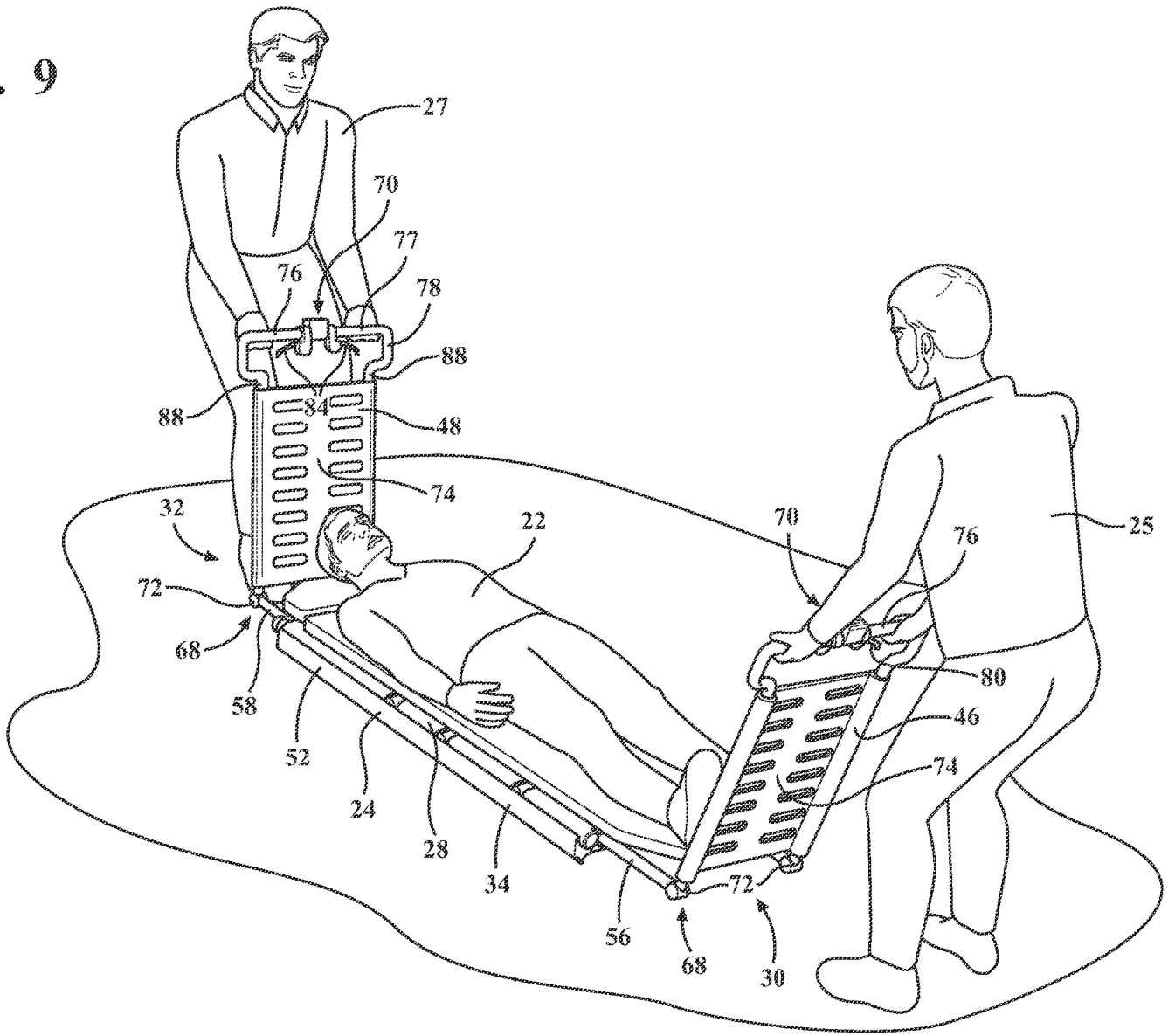
FIG. 9 is a perspective view of the patient support apparatus with the base removed, with a patient disposed on the litter and first and second caregivers grasping the first and second evacuation interfaces, respectively.
Figure 10:
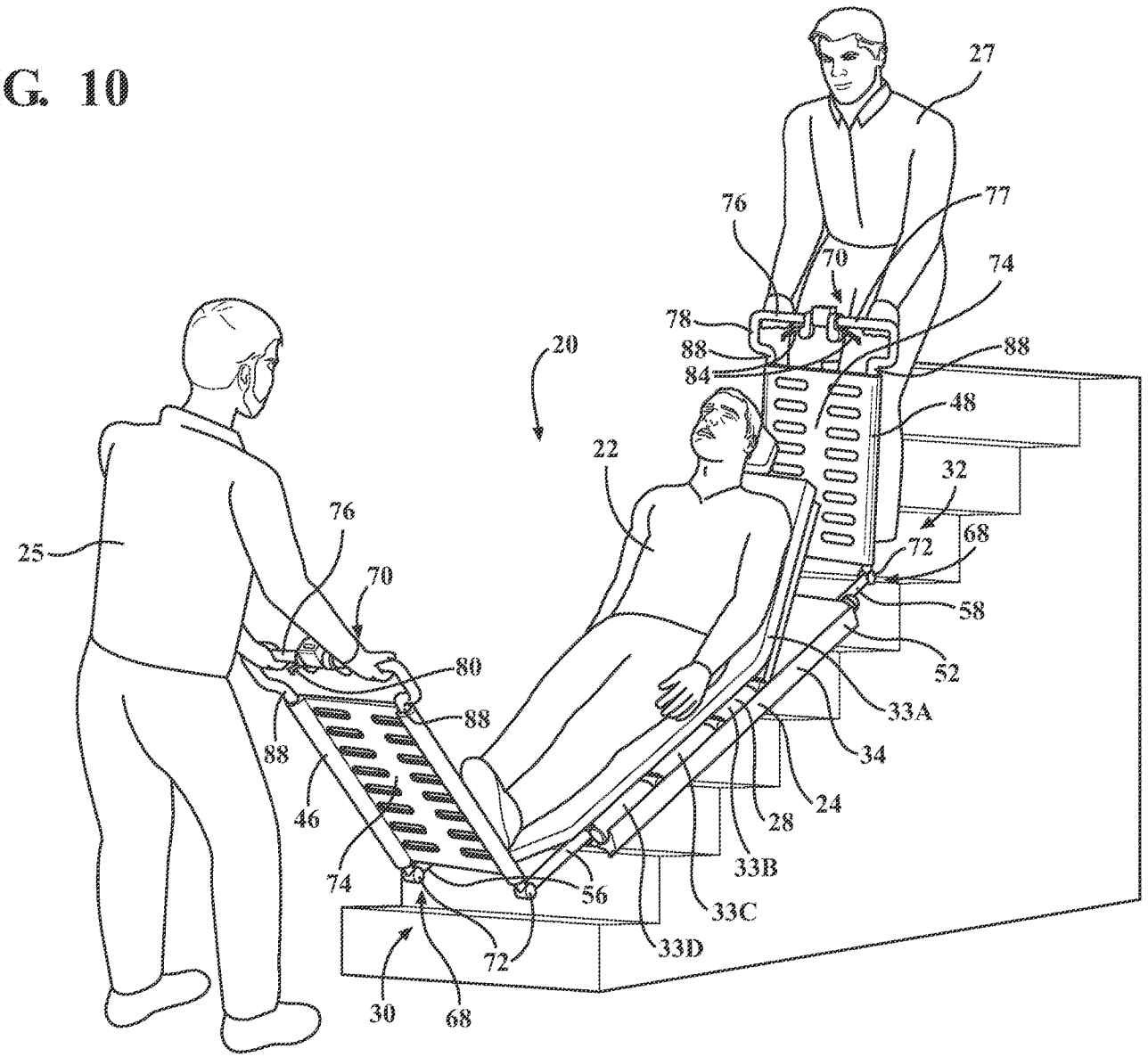
FIG. 10 is a perspective view of the patient support apparatus with the base removed, with the first and second caregivers moving the patient along a flight of stairs.
Figure 11:
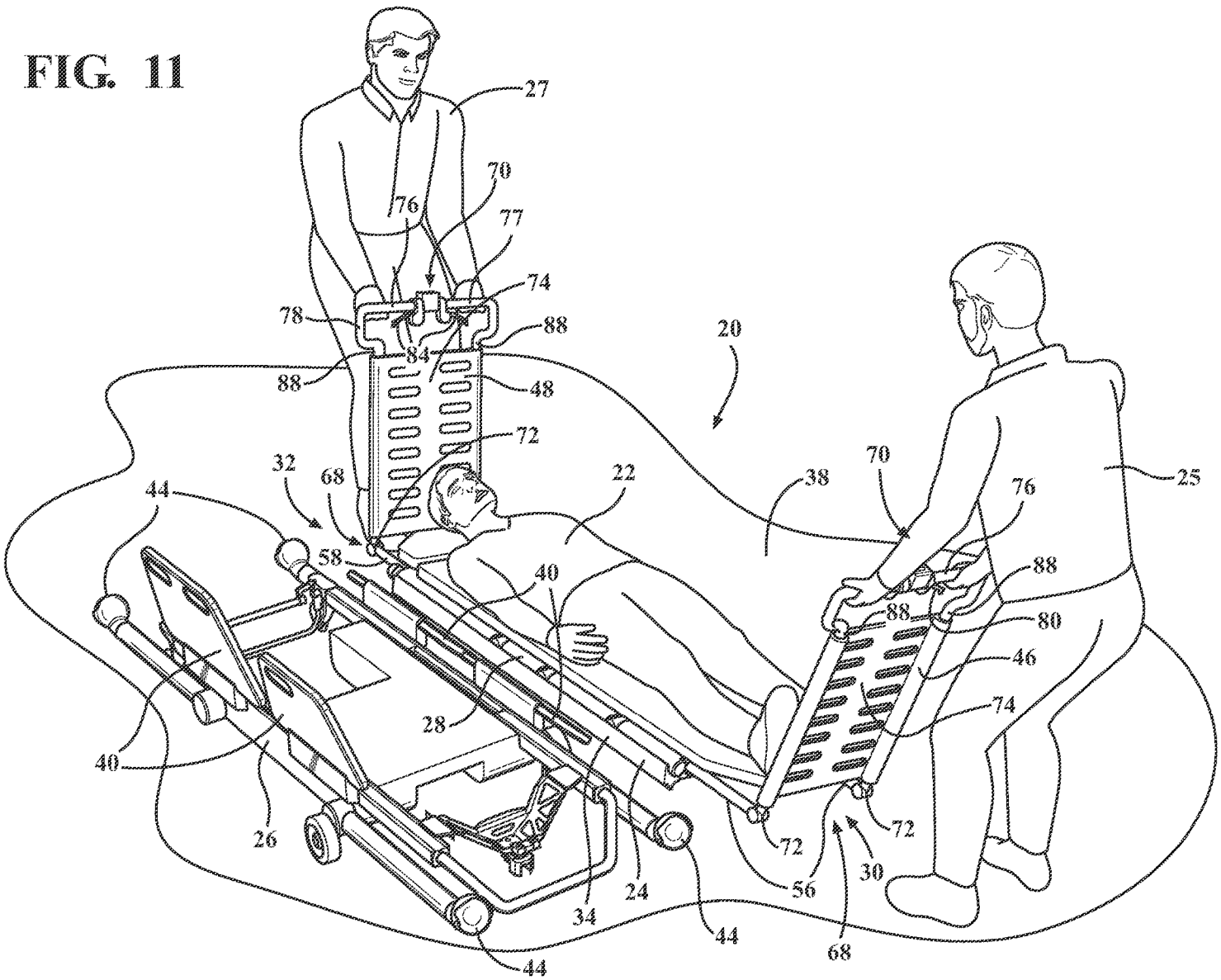
FIG. 11 is a side view of the patient support apparatus, with the first and second caregivers moving the patient onto the base.

As shown FIGS. 9-11, the patient support apparatus 20 may be configured so that, with the patient 22 disposed on the patient support deck 28, the first and second caregivers 25, 27 may lift the patient support apparatus 20 (and the patient 22) off a floor surface 38 and transport the patient 22 where desired.

Figure 2:
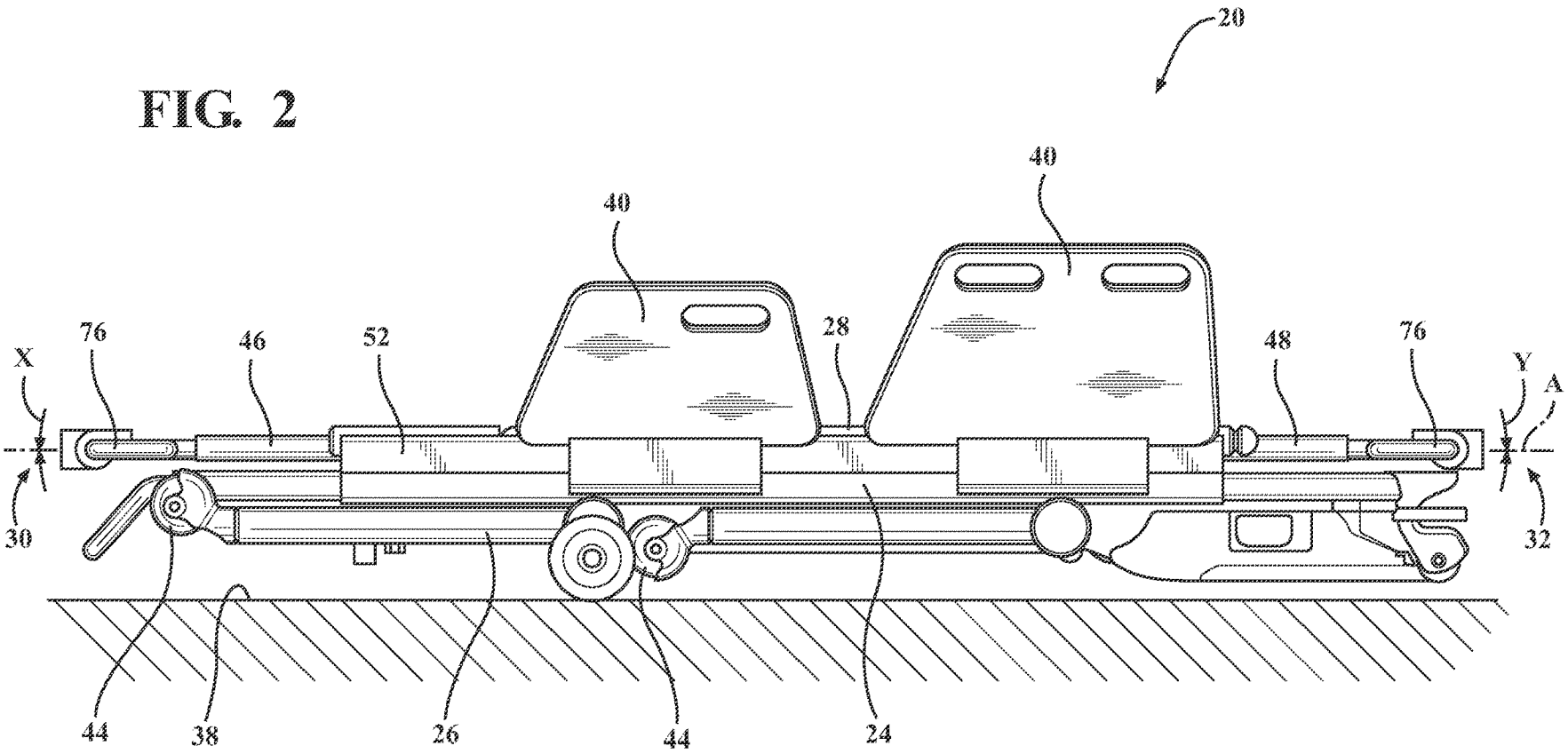
FIG. 2 is a side view of the patient support apparatus, with the base supporting the litter in a lowered base position.
Figure 3:
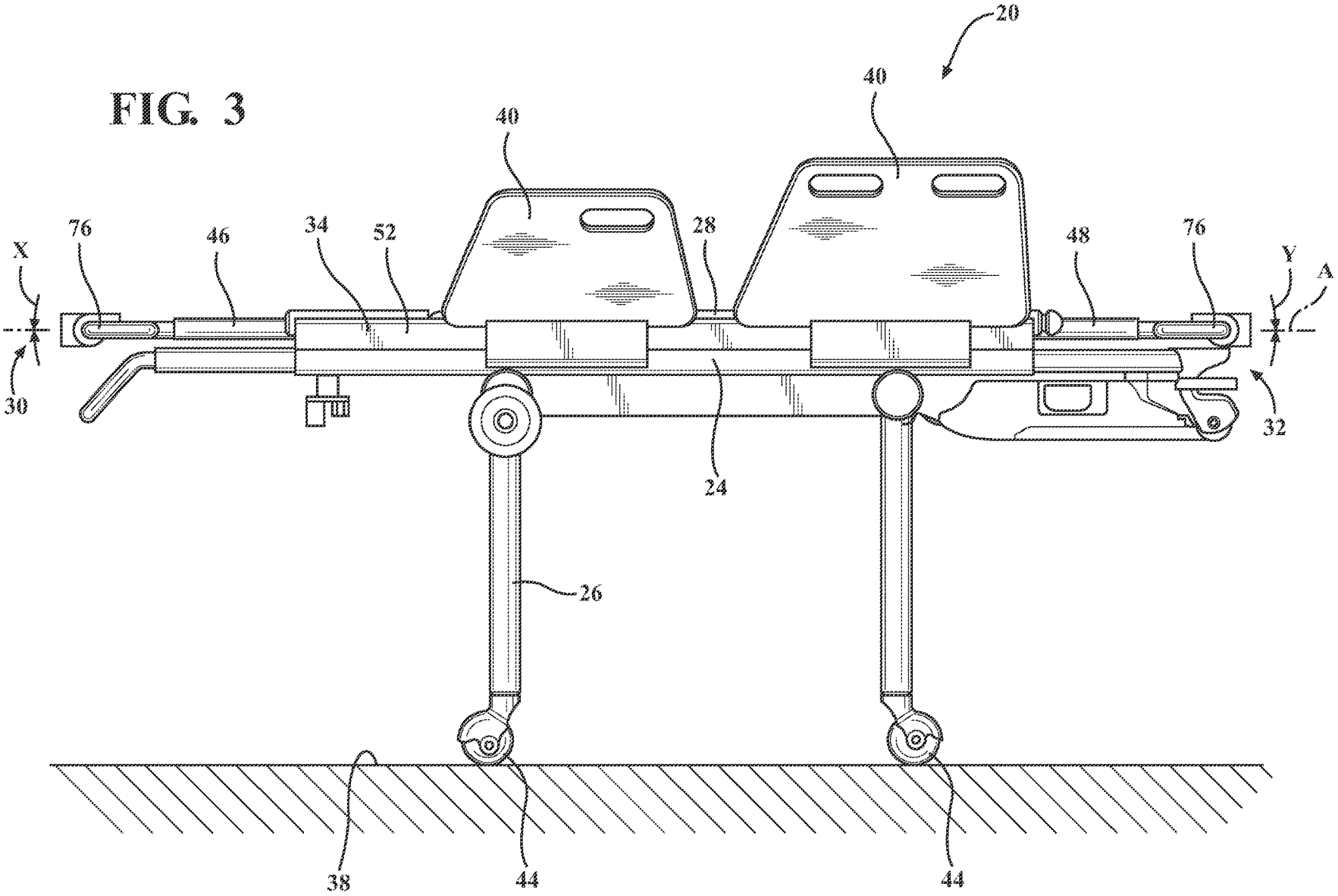
FIG. 3 is a side view of the patient support apparatus, with the base supporting the litter in a lifted base position.

Alternatively, the litter 24 may be configured to move along the floor surface 38. More specifically, as shown in FIGS. 1-4 and 11, the patient support apparatus 20 may comprise a base 26 selectively coupled to and supporting the litter 24. The base 26 may comprise a base lift device 36 (see FIG. 4) configured to raise and lower the patient support deck 28 relative to the floor surface 38 when the litter 24 is coupled to the base 26. More specifically, the base lift device 36 may be coupled to the base 26 and may be configured to move the litter 24 relative to the floor surface 38 between lifted (see FIG. 3) and lowered (see FIG. 11) base positions of the litter 24, and intermediate positions therebetween when the litter 24 is supported by the base 26. Moreover, the litter 24 may be moved into a loading base position as shown in FIG. 2 for facilitating loading of the litter 24 into an ambulance. The movement of the litter 24 between the lifted base position, the lowered base position, and the loading base position may be performed as described in U.S. patent application Ser. No. 16/019,994, which is hereby incorporated The base lift device 36 may be configured to operate in the same manner or a similar manner as the base lift devices shown in U.S. Pat. Nos. 7,398,571, 9,486,373, 9,510,981, and/or U.S. Patent Application Publication No. 2018/0028383, previously referenced. The base lift device 36 may be powered (hydraulic, electric, etc.) or may be manually operated.

The base 26 may be configured for movement of the litter 24 along the floor surface 38 (e.g., the ground). More specifically, the base 26 may comprise wheels 44 to facilitate transport over the floor surface 38. In the illustrated embodiments, the wheels 44 are caster wheels, which are able to rotate and swivel during transport. In addition, in some configurations, the wheels 44 are not caster wheels and may be non-steerable, steerable, non-powered, powered, or combinations thereof. Additional wheels are also contemplated. For example, the patient support apparatus 20 may comprise four non-powered, non-steerable wheels, along with one or more powered wheels. In some cases, the patient support apparatus 20 may not include any wheels. In other configurations, one or more auxiliary wheels (powered or non-powered), which are movable between stowed positions and deployed positions, may be coupled to the base 26. Other configurations are contemplated.

The litter 24 may be selectively separable from the base 26, as shown in FIG. 4. Said differently, the base 26 may be configured to removably receive and support the litter 24 in certain situations. In the illustrated embodiment, the litter 24 is configured for releasable attachment to the base 26. As will be appreciated from the subsequent description below, the litter 24 may be considered to be the patient support apparatus 20 both when it is attached to the base 26 (see FIGS. 1-3) and when it has been removed from the base 26 (see FIGS. 9-11).

Figure 5:
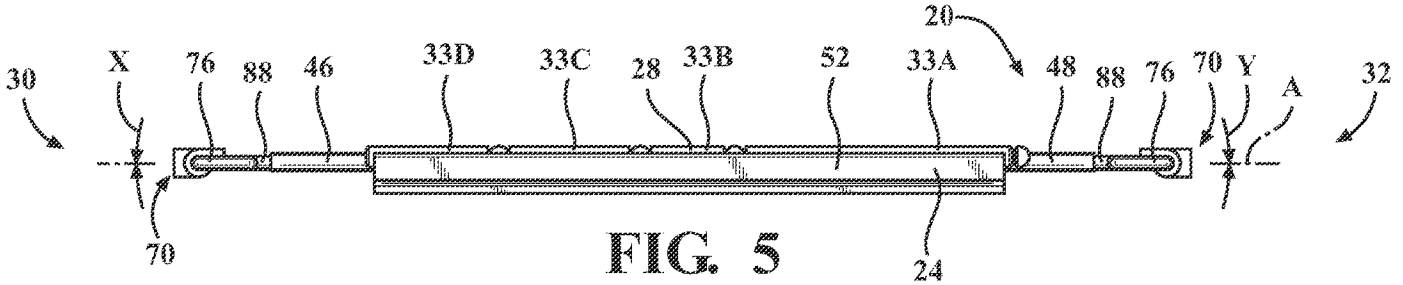
FIG. 5 is a side view of the patient support apparatus with the base removed, with the first evacuation interface in a first unfolded position and a first shortened position and the second evacuation interface in a second unfolded position and a second shortened position.
Figure 6:
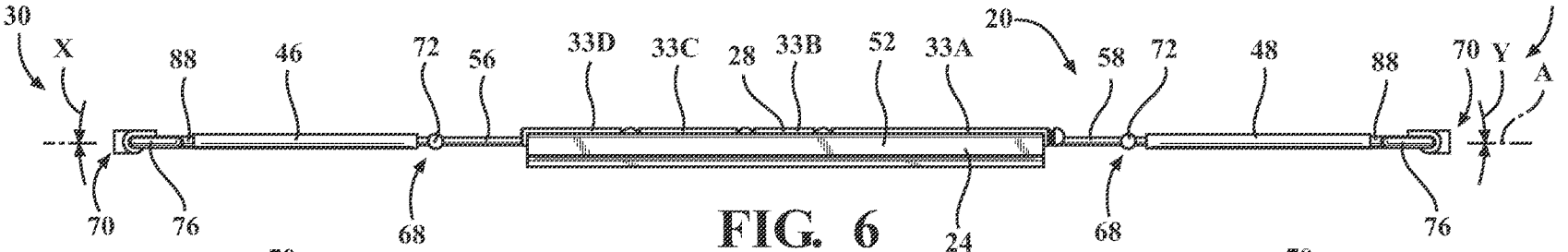
FIG. 6 is a side view of the patient support apparatus with the base removed, with the first evacuation interface in the first unfolded position and a first lengthened position and the second evacuation interface in the second unfolded position and a second lengthened position.
Figure 7:
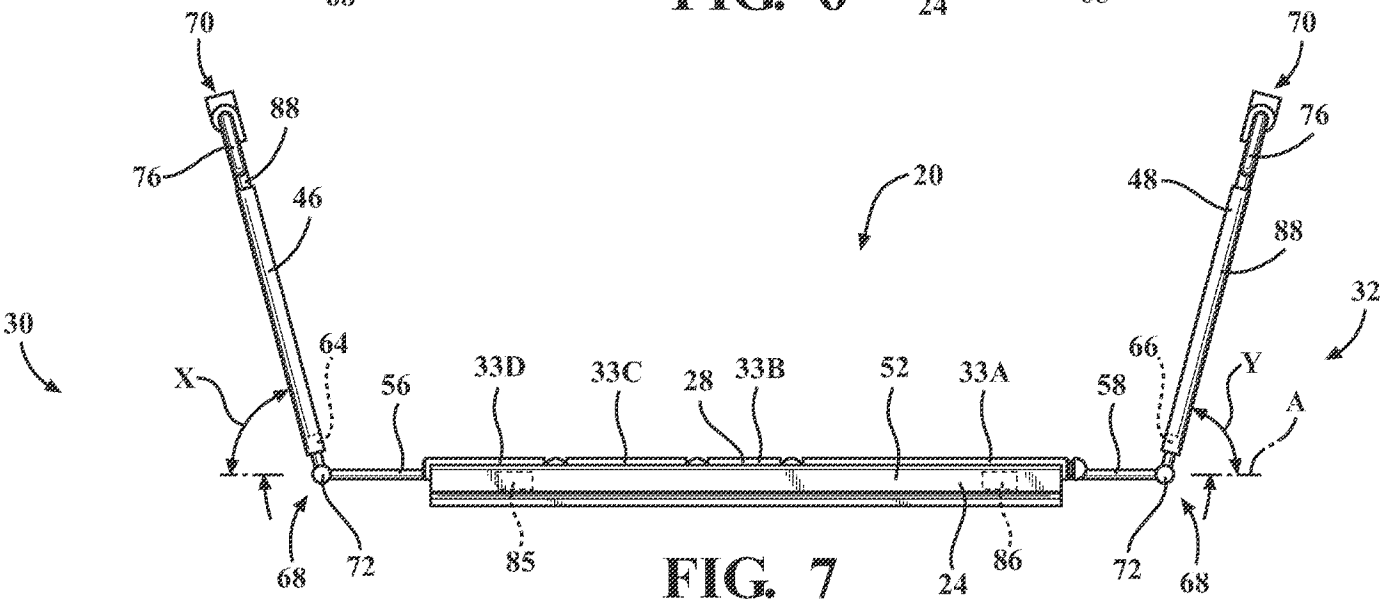
FIG. 7 is a side view of the patient support apparatus with the base removed, with the first evacuation interface in a first upright position and the first lengthened position and the second evacuation interface in a second upright position and the second lengthened position.

The patient support apparatus 20 further comprises a first evacuation interface 46 coupled to the litter 24 adjacent the first end 30 and defining a first angle X between the first evacuation interface 46 and the axis A. The first evacuation interface 46 is arranged to pivot relative to the litter 24 between a first unfolded position (see FIGS. 5 and 6) for stowing the evacuation interface and a first upright position (see FIG. 7) for access by the first caregiver 25, and intermediate positions therebetween. Said differently, the first evacuation interface 46 is positioned in a substantially horizontal orientation in the first unfolded position and in a substantially vertical orientation in the first upright position. As shown in FIGS. 5-7, the first angle X is the shortest angular measurement between the first evacuation interface 46 and the axis A. As such, the first angle X in the first unfolded position is less than the first angle X in the first upright position. The first evacuation interface 46 is arranged to move along the axis A between a first lengthened position (see FIGS. 6 and 7) and a first shortened position (see FIG. 5).

The patient support apparatus 20 further comprises a second evacuation interface 48 (similar to the first evacuation interface 46). The second evacuation interface 48 is coupled to the litter 24 adjacent the second end 32 and defines a second angle Y between the second evacuation interface 48 and the axis A. The second evacuation interface 48 is arranged to pivot relative to the litter 24 between a second unfolded position (see FIGS. 5 and 6) for stowing the evacuation interface and a second upright position (see FIG. 7) for access by the second caregiver 27, and intermediate positions therebetween. Said differently, the second evacuation interface 48 is positioned in a substantially horizontal orientation in the second unfolded position and in a substantially vertical orientation in the second upright position. As shown in FIGS. 5-7, the second angle Y is the shortest angular measurement between the second evacuation interface 48 and the axis A. As such, the second angle Y in the second unfolded position is less than the second angle Y in the second upright position. The second evacuation interface 48 is arranged to move along the axis A between a second lengthened position (see FIGS. 6 and 7) and a second shortened position (see FIG. 5).

The litter 24 defines at least one cavity 50 along the axis A. As shown in FIG. 8, the at least one cavity 50 is disposed below the patient support deck 28. However, the at least one cavity 50 may be defined by the patient support deck 28 itself, or may be positioned above the patient support deck 28 in alternative embodiments. The first and second evacuation interfaces 46, 48 are arranged to be independently disposed in the at least one cavity 50 when the first and second evacuation interfaces 46, 48 are in the first and second unfolded positions, respectively, and in the first and second shortened positions, respectively. Said differently, the first and second evacuation interfaces 46, 48 are stowed within the at least one cavity 50 for packaging and ease of transport to the patient 22 when the first and second evacuation interfaces 46, 48 are in the first and second unfolded positions, respectively, and in the first and second shortened positions, respectively. The first and second evacuation interfaces 46, 48 are configured to be grasped and lifted by the first and second caregivers 25, 27 when the first and second evacuation interfaces 46, 48 are in the first and second upright positions, respectively, for moving of the patient 22 supported by the litter 24.

As shown in FIG. 1, the litter 24 may comprise a pair of side frame rails 52 spaced from one another and extending along the axis A. The patient support deck 28 may extend between the pair of side frame rails 52. Each of the side frame rails 52 may have a rigid, substantially linear configuration, with the side frame rails 52 positioned substantially parallel to one another. As shown in FIG. 8, the litter 24 may comprise at least one lateral frame member 54 extending between the pair of side frame rails 52, with the patient support deck 28 disposed on top of the at least one lateral frame member 54 to support the patient support deck 28. In the embodiment shown in the Figures, the at least one lateral frame member 54 is a single lateral frame member 54 integrally formed of a single continuous material with the pair of side frame rails 52 to form a single unitary component. However, the at least one lateral frame member 54 may be comprised of any number of lateral frame members 54 integral with, or joined to, the pair of side frame rails 52 in any suitable manner.

The sections of the patient support deck 28 may articulate relative to the pair of side frame rails 52 and the at least one lateral frame member 54. However, in alternative embodiments the pair of side frame rails 52 and/or the at least one lateral frame member 54 may articulate with the sections of the patient support deck 28.

The at least one cavity 50 may be defined by the litter 24 below the patient support deck 28 and between the pair of side frame rails 52. In the embodiment shown in the FIG. 8, the single lateral frame member 54 entirely defines the at least one cavity 50 extending therethrough along the axis A. Moreover, the at least one cavity 50 is further defined as a single cavity 50 extending entirely through the single lateral frame member 54, with the first evacuation interface 46 arranged to be disposed in the single cavity 50 at the first end 30 of the litter 24 and the second evacuation interface 48 arranged to be disposed in the single cavity 50 at the second end 32 of the litter 24. However, the at least one cavity 50 may be any number of cavities defined by any component(s) of the litter 24 below the patient support deck 28.

Figure 12:
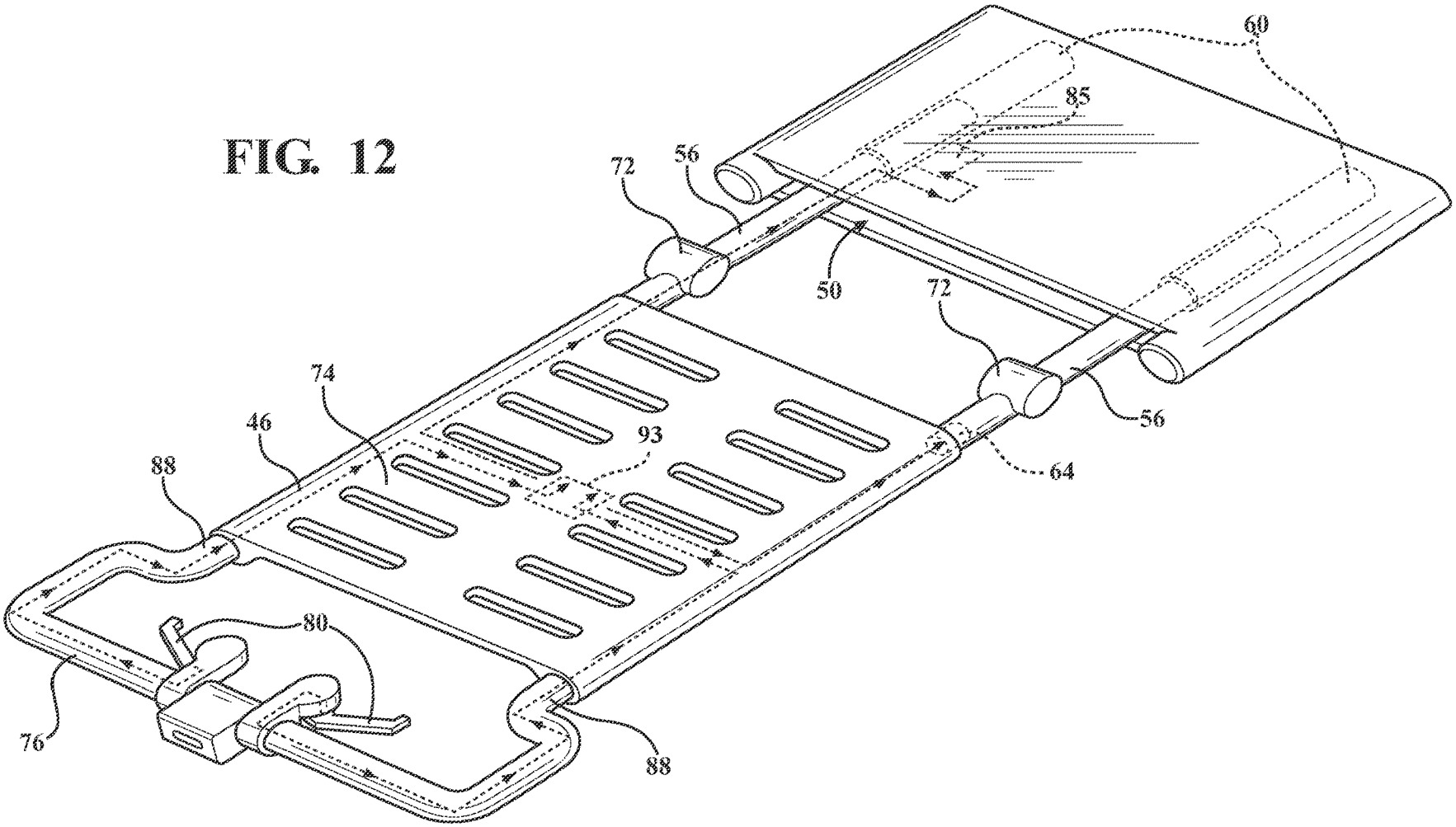
FIG. 12 a perspective view of a portion of the litter and the first evacuation interface showing the positioning of the first pivot lock mechanism and the first translation lock mechanism.

As shown in FIGS. 6, 7 and 12, the patient support apparatus 20 may further comprise a first translation member 56 coupled to each of the litter 24 and the first evacuation interface 46, with the first translation member 56 arranged to move longitudinally along the axis A to facilitate movement of the first evacuation interface 46 between the first lengthened and first shortened positions. Similarly, the patient support apparatus 20 may further comprise a second translation member 58 coupled to each of the litter 24 and the second evacuation interface 48 with the second translation member 58 arranged to move longitudinally along the axis A to facilitate movement of the second evacuation interface 48 between the second lengthened and second shortened positions.

The first and second translation members 56, 58 may be coupled to the litter 24 in any suitable manner that facilitates longitudinal movement of the first and second translation members 56, 58 along the axis A. In one non-limiting embodiment shown in FIG. 12, the litter 24 comprises a tube 60 disposed in the cavity 50 and configured to receive the first translation member 56 and/or second translation member 58 (which has a corresponding cylindrical shape). More specifically, the tube 60 is mounted to the frame rail 52 within the cavity 50 and extends longitudinally along the axis A. The shape of the bore laterally retains the first translation member 56 and/or second translation member 58, which defines the movement of the first translation member 56 and/or second translation member 58 only along the axis A. The tube 60 and the first and/or second translation members 56, 58 may each comprise an abutment surface extending orthogonal to the axis and configured to abut one another when the first and/or second translation members 56, 58 are moved away from the litter 24 beyond the first and/or second lengthened positions, respectively. In another non-limiting embodiment, the litter 24 comprises a plurality of rollers (not shown) rotatably coupled to the litter 24 and arranged to roll along the first translation member 56 and/or the second translation member 58 to retain movement of the first translation member 56 and/or the second translation member 58 only along the axis A. It will be appreciated that movement of the first and second translation members 56, 58 may be accomplished using any suitable mechanism.

The first evacuation interface 46 may be arranged to pivot relative to the first translation member 56 and the second evacuation interface 48 may be arranged to pivot relative to the second translation member 58. In one embodiment shown in FIGS. 6, 7, and 9-11, each of the first and second evacuation interfaces 46, 48 comprises a pair of frame members 88 spaced from one another and extending longitudinally with the litter 24 between a proximal end 68 and a distal end 70. Each of the first and second evacuation interfaces 46, 48 are coupled to the litter 24 at the proximal end 68. However, the first and second evacuation interfaces 46, 48 may be comprised of any number of frame members 88 pivotally coupled to the litter 24. Moreover, in alternative embodiments the first and second evacuation interfaces 46, 48 may each be a unitary component comprised of a single board pivotally coupled to the litter 24.

In the embodiment shown in FIGS. 6, 7, and 9-12, the patient support apparatus 20 further comprises a hinge 72 coupled to each of the pair of frame members 88 and the litter 24 to facilitate pivoting of the pair of frame members 88 of the first and second evacuation interfaces 46, 48 relative to the litter 24. However, the first and second evacuation interfaces 46, 48 may be pivotally coupled to the litter 24 with any suitable mechanism and in any suitable manner.

As described above, the first translation member 56 may couple the litter 24 with the first evacuation interface 46 and the second translation member 58 may couple the litter 24 with the second evacuation interface 48 to facilitate movement of the first and second evacuation interfaces 46, 48 longitudinally along the axis A. As such, the first evacuation interface 46 may be pivotally coupled to the first translation member 56 with the hinge 72 to facilitate both pivoting of the first evacuation interface 46 relative to the litter 24 and movement of the first evacuation interface 46 longitudinally along the axis A. Similarly, the second evacuation interface 48 may be pivotally coupled to the second translation member 58 with the hinge 72 to facilitate both pivoting of the second evacuation interface 48 relative to the litter 24 and movement of the second evacuation interface 48 longitudinally along the axis A.

The first evacuation interface 46 may pivot away from the litter 24 between the first unfolded position and the first upright position and the second evacuation interface 48 may pivot away from the litter 24 between the second unfolded position and the second upright position. Moreover, the first evacuation interface 46 and the axis A may be substantially parallel when the first evacuation interface 46 is in the first unfolded position, as shown in FIGS. 5 and 6. Similarly, the second evacuation interface 48 and the axis A may be substantially parallel when the second evacuation interface 48 is in the second unfolded position. Said differently, the first evacuation interface 46 and the first translation member 56 may be positioned end-to-end in a substantially planar configuration along the axis A in the first unfolded position to facilitate insertion of the first evacuation interface 46 and the first translation member 56 into the cavity 50 in the first shortened position. Likewise, the second evacuation interface 48 and the second translation member 58 may be positioned end-to-end in a substantially planar configuration along the axis A in the second unfolded position to facilitate insertion of the second evacuation interface 48 and the second translation member 58 into the cavity 50 in the second shortened position. However, the first and second evacuation interfaces 46, 48 may be configured to pivot toward the litter 24 such that the first and second evacuation interfaces 46, 48 are stacked upon or nested with the first and second translations members respectively.

At least one of the first and second evacuation interfaces 46, 48 may comprises a panel 74 extending between and mounted to each of the pair of frame members 88 and extending longitudinally along the pair of frame members 88 between the proximal and distal ends 68, 70. As shown in FIGS. 1 and 8-12, both of the first and second evacuation interfaces 46, 48 may comprise the panel 74. The panel 74 is configured to support an object when the at least one of the first and second evacuation interfaces 46, 48 is disposed in at least the first unfolded position or the second unfolded position, respectively. More specifically, the panel 74 has a substantially planar configuration that provides a substantially horizontal surface when the first or second evacuation interface 46, 48 is in the first or second unfolded position, respectively. As such, the panel 74 in the first or second unfolded position, and the first or second lengthened position, provides a surface to dispose and support various items, such as medical equipment, personal items of the patient 22, etc.

The panel 74 shown in the Figures has a rigid configuration. However, the panel 74 may be comprised of a flexible material, such as mesh, webbing, or netting.

Although the panel 74 is configured to support an object when positioned in the first and second unfolded configurations (i.e., the substantially horizontal configuration), the panel 74 may support certain objects in the intermediate positions between the first and second unfolded positions and the first and second upright positions (i.e., the substantially vertical configuration). More specifically, the panel 74 disposed in the intermediate positions comprise a surface having a horizontal component that may overcome the force of gravity if the force of static friction between the panel 74 and the object is greater than the force of gravity.

As shown in FIGS. 1, 4, and 8-12, each of the first and second evacuation interfaces 46, 48 may comprise a handle 76 mounted to and extending between the pair of frame members 88 and configured to be grasped by the first and second caregivers 25, 27 to move the litter 24. The handle 76 may comprise a lateral portion 77 extending between the pair of frame members 88.

The handle 76 may be disposed at the distal end 70 of each of the pair of frame members 88. As such, the handle 76 may be spaced from the litter 24 in order to position the handle 76 proximate the hands of the first and second caregivers 25, 27 when the litter 24 is disposed on the floor surface 38 and the first and second evacuation interfaces 46, 48 are disposed in the first and second upright positions, respectively. Positioning the handle 76 proximate the hands of the first and second caregivers 25, 27 provides improved ergonomics to the caregivers, which reduces strain on the caregivers when moving the patient support apparatus 20 and reduces the potential for injuring the caregivers. The handle 76 may further include a longitudinal portion 78 extending substantially parallel to the pair of frame members 88 to provide an engagement surface to be grasped by the caregiver that is different from the lateral portion 77 of the handle 76. As such, the handle 76 provides multiple handle positions for the caregiver, which further improves the ergonomics of the handle 76. It will be appreciated that the handle 76 may have any suitable configuration for being grasped by the caregivers.

As shown in FIG. 1, the patient support apparatus 20 may further comprise an illumination device 82 mounted to the handle 76 of one or more of the first and second evacuation interfaces 46, 48. The illumination device 82 is configured to illuminate the patient support deck 28 when the one of the first and second evacuation interfaces 46, 48 is in the first upright position or the second upright position, respectively. The illumination device 82 may be a pair of illumination devices 82, with one of the pair of illumination devices 82 mounted to the handle 76 of the first evacuation interface 46 and the other one of the pair of illumination devices 82 mounted to the handle 76 of the second evacuation interface 48. However, the illumination device 82 may be mounted to any portion of either of the first and second evacuation interfaces 46, 48.

The illumination device 82 may be articulable relative to the handle 76. Articulation of the illumination device 82 facilitates changing the area of the patient support deck 28 that is illuminated by the illumination device 82. The illumination device 82 may be coupled to the handle 76 in any suitable manner to facilitate adjusting the illumination of the patient support deck 28.

The illumination device 82 may include a light source. The light source may be further defined as a light emitting diode. Alternatively, the light source may be further defined as a laser light source. In any embodiment, the light source is capable of emitting any type of light. For example, the light source may be capable of emitting visible light across the color spectrum. As another example, the light source may also be capable of emitting non-visible light such as ultraviolet light that may illuminate a fluorescent material on the surface. It is to be appreciated that the light source may be a single-color semi-conductor light source capable of emitting what is typically referred to as visible white light. It is also to be appreciated that the light source may be a multi-color light source with the light source capable of emitting specific colors of the visible spectrum of the light. For example, the light source may be a red-green-blue (RGB) LED capable of individually emitting visible red, green, and blue light, or in combination emitting colored light formed by the combination of at least two of the visible red, green, and blue light.

In addition, the light source may be capable of emitting the light in any direction. For example, the light source may be a 60 degree light source, with the light source emitting the light in a conical shape having an angle of 60 degrees between the outer most light as measured along a plane extending through a center of the light. It is to be appreciated that light source may be a 120 degree light source. It is also be appreciated that the light source may emit the light at any suitable angle.

In any embodiment, the light source is capable of emitting the light at any intensity. It will be appreciated that the light source could be of any suitable type or configuration and could include any suitable number of light sources.

As shown in FIG. 12, a first pivot lock mechanism 64 may be coupled to each of the first evacuation interface 46 and the first translation member 56 to retain the first evacuation interface 46 in the first unfolded position, first upright position, and intermediate positions therebetween. A second pivot lock mechanism 66 may be coupled to each of the second evacuation interface 48 and the second translation member 58 to retain the second evacuation interface 48 in the second unfolded position, second upright position, and intermediate positions therebetween.

Figure 13:
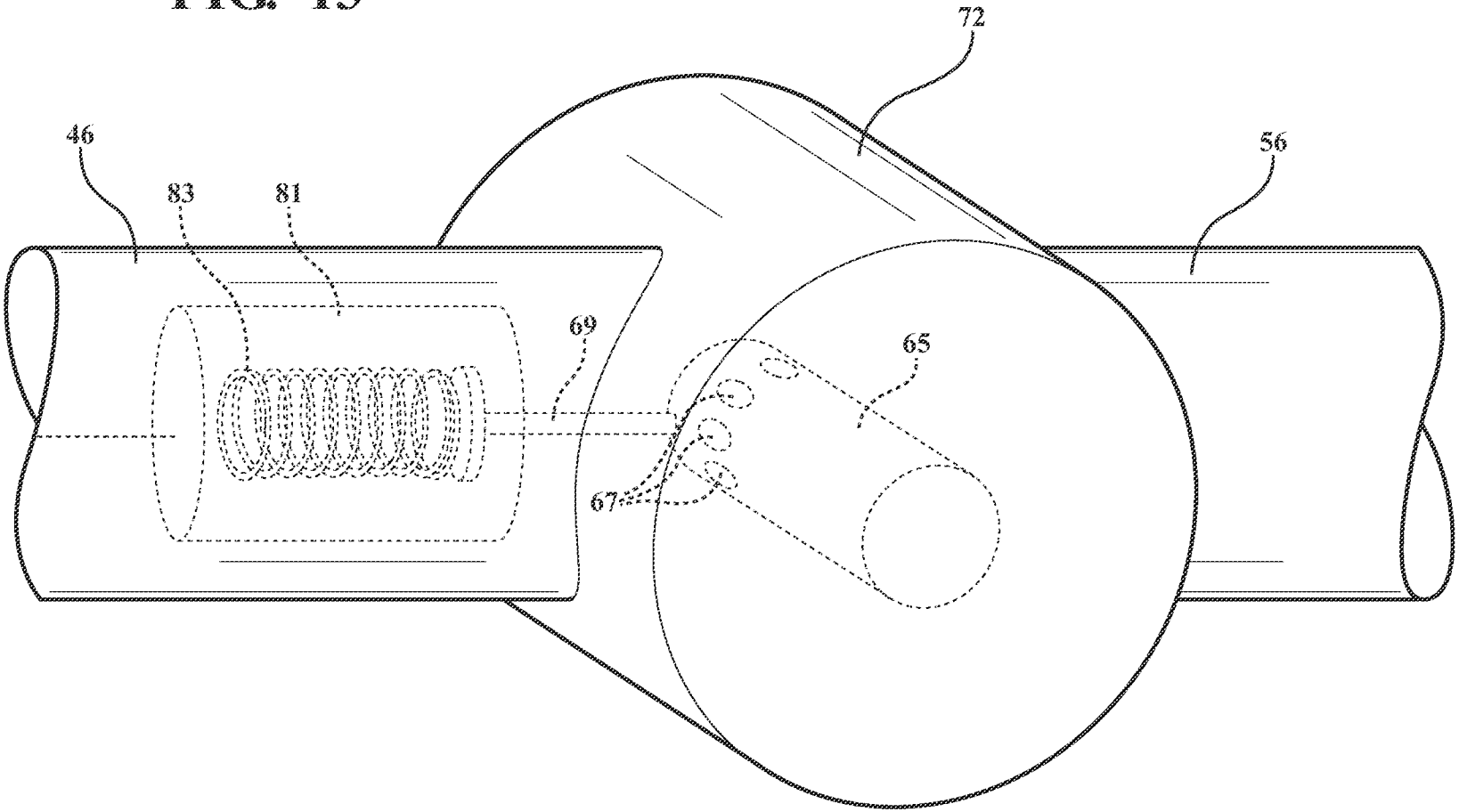
FIG. 13 is perspective view of the first pivot lock mechanism.

FIG. 13 shows an exemplary embodiment of the first pivot lock mechanism 64. The exemplary embodiment shown in FIG. 13 is applicable to the second pivot lock mechanism 66. The first pivot lock mechanism 64 comprises a shaft 65 fixed to the first translation member 56. The first evacuation interface 46 pivots about the shaft 65. The shaft 65 defines a plurality of holes 67 radially spaced about the shaft 65. The first pivot lock mechanism 64 further comprises a pin 69 mounted to the first evacuation interface 46 and movable between an engaged position in contact with the shaft 65 and a disengaged position spaced from the shaft 65. In the engaged position, the pin 69 contacts the shaft 65 within one of the holes 67 to retain the first evacuation interface 46 relative to the first translation member 56. In the disengaged position, the pin 69 is spaced from the shaft 65 and the first evacuation interface 46 is permitted to freely pivot relative to the first translation member 56. This configuration of the first pivot lock mechanism 64 is referred to as a pin and hole lock. It will be appreciated that the first pivot lock mechanism 64 and the second pivot lock mechanism 66 may comprise any other suitable configuration for retaining the first or second evacuation interface 46, 48 relative to the first or second translation member 58, respectively, including but not limited to, a pivoting latch lock and a ball detent lock.

As shown in FIGS. 1, 4, and 8-12, the first evacuation interface 46 may comprise at least one first actuator 80 and the second evacuation interface 48 may comprise at least one second actuator 84. The first and second actuators 80, 84 may be pivotally coupled to their respective first and second evacuation interfaces 46, 48. As shown in the Figures, the first and second actuators 80, 84 may be a pair of first and second actuators 80, 84. One of the pair of first actuators 80 may be coupled to the first pivot lock mechanism 64 and one of the pair of second actuators 84 may be coupled to the second pivot lock mechanism 66. Pivoting of the first and second actuators 80, 84 may actuate the respective first and second pivot lock mechanisms 64, 66 to selectively retain the respective first and second evacuation interfaces 46, 48 relative to the first and second translation members 56, 58. More specifically, pivoting of the first and second actuators 80, 84 may disconnect the respective first and second evacuation interfaces 46, 48 from the respective first and second translation members 56, 58 to allow pivoting therebetween (i.e., move the pin 69 shown in FIG. 13 to the disengaged position).

The first and second actuators 80, 84 may be electronically coupled to the respective first and second pivot lock mechanisms 64, 66. The first and second actuators 80, 84 may be coupled to a controller 93 as shown in FIG. 12. The first and second actuators 80, 84 transmit input signals to the controller 93, and the controller 93 controls operation of the first and second pivot lock mechanisms 64, 66 or any powered devices based on the input signals from the first and second actuators 80, 84, respectively.

In the non-limiting embodiment shown in FIG. 13, a solenoid 81 is coupled to the pin 69 of the first pivot lock mechanism 64. A bias member 83 engages and biases the pin 69 toward the engaged position. Pivoting of the first actuator 80 energizes the solenoid 81, which moves the pin 69 away from the shaft 65 toward the disengaged position, against the bias of the bias member 83. When the first actuator 80 is released, the solenoid 81 is de-energized and the bias of the bias member 83 moves the pin 69 to the engaged position. The first actuator 80 may be electronically coupled to the first pivot lock mechanism 64 in any suitable manner. The first actuator 80 may be coupled to the first pivot lock mechanism in any suitable manner, including, but not limited to, manual actuation (e.g., through actuation of a Bowden cable or linkages) and hydraulic actuation (e.g., through movement of a fluid between pistons). The above description of the coupling between the first actuator 80 and the first pivot lock mechanism 64 is applicable to the coupling between the second actuator 84 and the second pivot lock mechanism 66.

Figure 14:
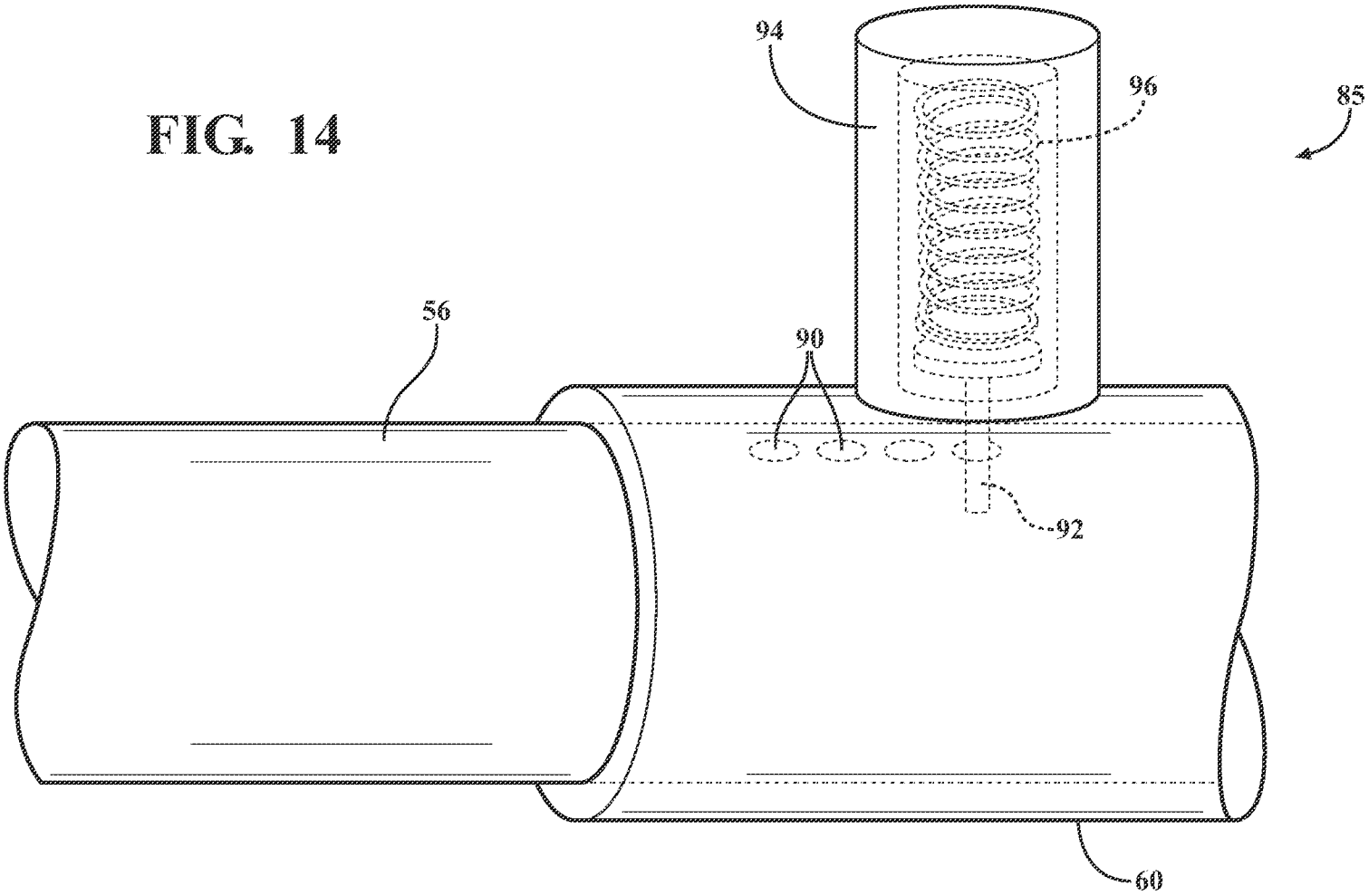
FIG. 14 is a perspective view of the first translation lock mechanism.

The other one of the pair of first actuators 80 may be coupled to a first translation lock mechanism 85 selectively coupling the first translation member 56 with the litter 24 and the other one of the pair of second actuators 84 may be coupled to a second translation lock mechanism 86 selectively coupling the second translation member 58 with the litter 24. The exemplary embodiment of the first pivot lock mechanism 64 described above and shown in FIG. 13 may be applied to the first and second translation lock mechanisms 85, 86. More specifically, FIG. 14 shows an exemplary embodiment of the first translation lock mechanism 85. The exemplary embodiment shown in FIG. 14 is applicable to the second translation lock mechanism 86. The first translation member 56 defines a plurality of holes 90 spaced linearly along the axis A. The first translation lock mechanism 85 further comprises a pin 92 mounted to the litter 24 (shown in FIG. 14 as the tube 60 of the litter) and movable between an engaged position in contact with the first translation member 56 and a disengaged position spaced from the first translation member 56. In the engaged position, the pin 92 contacts the first translation member 56 within one of the holes 90 to retain the first translation member 56 relative to the litter 24. In the disengaged position, the pin 92 is spaced from the first translation member 56 and the first translation member 56 is permitted to freely move along the axis A relative to the litter 24. This configuration of the first translation member 56 is referred to as a pin and hole lock. It will be appreciated that the first translation lock mechanism 85 and the second translation lock mechanism 86 may comprise any other suitable configuration for retaining the first or second translation members 56, 58 relative to the litter 24, respectively, including but not limited to, a pivoting latch lock and a ball detent lock.

The other first and second actuators 80, 84 may be electronically coupled to the respective first and second translation lock mechanisms 85, 86. The other first and second actuators 80, 84 may be coupled to the controller 93 as shown in FIG. 12. The first and second actuators 80, 84 transmit input signals to the controller 93, and the controller 93 controls operation of the first and second translation lock mechanisms 85, 86 or any powered devices based on the input signals from the first and second actuators 80, 84, respectively.

In the non-limiting embodiment shown in FIG. 14, a solenoid 94 is coupled to the pin 92 of the first translation lock mechanism 85. A bias member 96 engages and biases the pin 92 toward the engaged position. Pivoting of the first actuator 80 energizes the solenoid 94, which moves the pin 92 away from the first translation member 56 toward the disengaged position, against the bias of the bias member 96. When the first actuator 80 is released, the solenoid 94 is de-energized and the bias of the bias member 96 moves the pin 92 to the engaged position. The first actuator 80 may be electronically coupled to the first translation lock mechanism 85 in any suitable manner, including, but not limited to, manual actuation (e.g., through actuation of a Bowden cable or linkages) and hydraulic actuation (e.g., through movement of a fluid between pistons). The above description of the coupling between the first actuator 80 and the first translation lock mechanism 85 is applicable to the coupling between the second actuator 84 and the second translation lock mechanism 86.

Although the exemplary embodiment of the first and second actuators 80, 84 are shown in the Figures as levers, the first and second actuators 80, 84 may be any suitable configuration (including buttons, joysticks, touchscreens, etc.) to be engaged by the first and second caregivers 25, 27.

As shown in FIGS. 1-4 and 11, the base 26 may further comprise a side board 40 arranged to be disposed along the litter 24 between the first and second ends 30, 32. The side board 40 may extend laterally away from the patient support deck 28. The side board 40 may be arranged to pivot relative to the litter 24 between a first position (see FIGS. 1-4) and a second position (see FIG. 11). In some embodiments, the side board 40 may be pivoted to additional positions between the first and second positions. In the first position, the side board 40 is planar with or angled upwardly to extend above the patient support deck 28 for inhibiting patient 22 egress. In the second position, the side board 40 is angled downwardly to extend below the patient support deck 28 to facilitate loading of the patient 22 from the floor surface 38 to the patient support deck 28.

The litter 24 may comprise a pair of opposing lateral sides 34 between the first and second ends 30, 32. The side board 40 may be further defined as a pair of side boards 40. One of the side boards 40 may be disposed along one of the lateral sides 34 and the other one of the side boards 40 may be disposed along the other one of the lateral sides 34. The pair of side boards 40 may be configured to retain the patient 22 between the side boards 40 on the patient support deck 28 when both of the pair of side boards 40 are in the first position. More specifically, the patient 22 may be positioned between the pair of side boards 40 in the first position, with pair of side boards 40 engaging the patient 22 to prevent inadvertent movement of the patient 22 laterally off of the patient support deck 28 (e.g., during transport).

The pair of side boards 40 may be configured to facilitate movement of the patient 22 along either of the side boards 40 during loading of the patient 22 from the floor surface 38 to the patient support deck 28. Said differently, the litter 24 may configured to accommodate movement of the patient 22 up to the patient support deck 28 when the patient 22 is located on either of the pair of opposing lateral sides 34, increasing versatility of the patient support apparatus 20.

The pair of side boards 40 may be pivotable independently of one another between respective first and second positions. As such, one of the pair of side boards 40 may be in the second position to permit movement of the patient 22 from the floor surface 38 to the patient support deck 28, while the other one of the pair of side boards 40 may be in the first position (see FIG. 11), which may engage the patient 22 after the patient 22 is placed on the patient support deck 28 (i.e., the other side board 40 in the first position extends the patient support deck 28 and may present a stop to prevent accidentally pushing the patient 22 off of the patient support deck 28.) However, the pair of side boards 40 may both be simultaneously disposed in either of the first or second positions (see FIGS. 1-4).

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology that has been used is intended to be in the nature of words of description rather than of limitation. Many modifications and variations are possible in light of the above teachings and the invention may be practiced otherwise than as specifically described.

What is claimed is:

1. A patient support apparatus for supporting a patient for movement assisted by first and second caregivers, said patient support apparatus comprising:

a litter comprising a patient support deck configured to support the patient, with said litter extending longitudinally along an axis between a first end and a second end, and with said litter defining at least one cavity along said axis;

a first evacuation interface coupled to said litter adjacent said first end and defining a first angle between said first evacuation interface and said axis, with said first evacuation interface arranged to pivot relative to said litter between a first unfolded position for stowing said evacuation interface and an first upright position for access by the first caregiver, with said first angle in said first unfolded position less than said first angle in said first upright position, and with said first evacuation interface arranged to move along said axis between a first lengthened position and a first shortened position; and a second evacuation interface coupled to said litter adjacent said second end and defining a second angle between said second evacuation interface and said axis, with said second evacuation interface arranged to pivot relative to said litter between a second unfolded position for stowing said evacuation interface and a second upright position for access by the second caregiver, with said second angle in said second unfolded position less than said second angle in said second upright position, and with said second evacuation interface arranged to move along said axis between a second lengthened position and a second shortened position;

wherein said first and second evacuation interfaces are arranged to be independently disposed in said at least one cavity when said first and second evacuation interfaces are in the first and second unfolded positions, respectively, and in the first and second shortened positions, respectively, and said first and second evacuation interfaces are configured to be grasped and lifted by the first and second caregivers when said first and second evacuation interfaces are in the first and second upright positions, respectively, for moving of the patient supported by said litter.

2. The patient support apparatus as set forth in claim 1, further comprising a base selectively coupled to and supporting said litter, said base comprising a base lift device configured to raise and lower said patient support deck relative to a floor surface when said litter is coupled to said base.

3. The patient support apparatus as set forth in claim 1, further comprising a first translation member coupled to each of said litter and said first evacuation interface, with said first evacuation interface arranged to pivot relative to said first translation member and with said first translation member arranged to move longitudinally along said axis to facilitate movement of said first evacuation interface between said first lengthened and first shortened positions.

4. The patient support apparatus as set forth in claim 1, further comprising a second translation member coupled to each of said litter and said second evacuation interface, with said second evacuation interface arranged to pivot relative to said second translation member and with said second translation member arranged to move longitudinally along said axis to facilitate movement of said second evacuation interface between said second lengthened and second shortened positions.

5. The patient support apparatus as set forth in claim 1, wherein said litter comprises a pair of side frame rails spaced from one another and extending along said axis and said patient support deck extends between said pair of side frame rails.

6. The patient support apparatus as set forth in claim 5, wherein said at least one cavity is defined by said litter below said patient support deck and between said pair of side frame rails.

7. The patient support apparatus as set forth in claim 1, wherein said first evacuation interface is arranged to pivot away from said litter between said first unfolded position and said first upright position and said second evacuation interface is arranged to pivot away from said litter between said second unfolded position and said second upright position.

8. The patient support apparatus as set forth in claim 1, wherein each of said first and second evacuation interfaces comprises a pair of frame members spaced from one another and extending longitudinally with said litter between a proximal end and a distal end, with each of said first and second evacuation interfaces coupled to said litter at said proximal end.

9. The patient support apparatus as set forth in claim 8, further comprising a hinge coupled to each of said pair of frame members and said litter to facilitate pivoting of said pair of frame members relative to said litter.

10. The patient support apparatus as set forth in claim 8, wherein at least one of said first and second evacuation interfaces comprises a panel extending between and mounted to each of said pair of frame members and extending longitudinally along said pair of frame members between said proximal and distal ends, with said panel configured to support an object when said at least one of said first and second evacuation interfaces is disposed in at least said first unfolded position or said second unfolded position, respectively.

11. The patient support apparatus as set forth in claim 8, wherein said each of said first and second evacuation interfaces comprises a handle mounted to and extending between said pair of frame members and configured to be grasped by the first and second caregivers to move said litter.

12. The patient support apparatus as set forth in claim 11, further comprising an illumination device mounted to said handle of one of said first and second evacuation interfaces and configured to illuminate said patient support deck when said one of said first and second evacuation interfaces is in said first upright position or said second upright position, respectively.

13. The patient support apparatus as set forth in claim 11, wherein said handle is disposed at said distal end of each of said pair of frame members.

14. The patient support apparatus as set forth in claim 1, wherein said first evacuation interface and said axis are substantially parallel when said first evacuation interface is in said first unfolded position and said second evacuation interface and said axis are substantially parallel when said second evacuation interface is in said second unfolded position.

15. The patient support apparatus as set forth in claim 2, wherein said base further comprises a side board arranged to be disposed along said litter between said first and second ends and extending laterally away from said patient support deck, with said side board arranged to pivot relative to said litter between a first position planar with or angled upwardly to extend above said patient support deck for inhibiting patient egress and a second position angled downwardly to extend below said patient support deck to facilitate loading of the patient from the floor surface to said patient support deck.

16. The patient support apparatus as set forth in claim 15, wherein said litter comprises a pair of opposing lateral sides between said first and second ends, with said side board further defined as a pair of side boards with one of said side boards disposed along one of said lateral sides and the other one of said side boards disposed along the other one of said lateral sides and configured to retain the patient between said side boards on said patient support deck when both of said pair of side boards are in said first position.

* * * * *